US005747412A

United States Patent [19]

Leenders et al.

[11] Patent Number: 5,747,412

[45] Date of Patent: May 5, 1998

[54] THERMOGRAPHIC MATERIAL WITH OUTERMOST ANTISTATIC LAYER

[75] Inventors: Luc Leenders, Herentals; Geert Defieuw, Bonheiden; Bart Horsten, Rumst; Hans Strijckers, Oudergem, all of Belgium

[73] Assignee: AGFA-Gevaert N.V., Mortsel, Belgium

[21] Appl. No.: 753,794

[22] Filed: Nov. 29, 1996

[30] Foreign Application Priority Data

| | | | |
|---|---|---|---|
| Nov. 27, 1995 | [EP] | European Pat. Off. | 95203244.9 |
| Nov. 27, 1995 | [EP] | European Pat. Off. | 95203246.4 |
| Dec. 27, 1995 | [EP] | European Pat. Off. | 95203634.1 |
| Jun. 1, 1996 | [EP] | European Pat. Off. | 96201528.5 |

[51] Int. Cl.[6] ..... B41M 5/28

[52] U.S. Cl. ..... 503/201; 427/150; 427/152; 430/620; 503/202; 503/207; 503/210; 503/226

[58] Field of Search ..... 427/152, 150, 427/151; 503/202, 210, 226, 201, 207, 200; 430/620

[56] References Cited

FOREIGN PATENT DOCUMENTS 678776 8/1996 European Pat. Off. ..... 503/226

*Primary Examiner*—Bruce H. Hess

*Attorney, Agent, or Firm*—Baker & Botts, L.L.P.

[57] ABSTRACT

A (photo)thermographic recording material comprising a (photo-addressable) thermosensitive element, a support and an outermost antistatic layer, the thermosensitive element comprising a substantially light-insensitive organic silver salt, an organic reducing agent for the substantially light-insensitive organic silver salt in thermal working relationship therewith and a binder, characterized in that the outermost antistatic layer is an organic layer with a resistivity of $<10^{10}\Omega/\square$ at a relative humidity of 30%. The outermost antistatic layer may comprise a polythiophene with conjugated polymer backbone in the presence of a polymeric polyanion compound and a hydrophobic organic polymer having a glass transition value ($T_g$) of at least 40° C., the polythiophene being present at a coverage of at least 0.001 g/m$^2$ and the weight ratio of the polythiophene to the hydrophobic organic polymer being in the range of 1/10 to 1/1000. A production process for the thermographic recording material and a thermographic recording process therefor are also provided.

15 Claims, No Drawings

THERMOGRAPHIC MATERIAL WITH OUTERMOST ANTISTATIC LAYER

FIELD OF THE INVENTION

The present invention relates to thermographic and photothermographic materials and antistatic layers therefor.

BACKGROUND OF THE INVENTION

Thermal imaging or thermography is a recording process wherein images are generated by the use of imagewise modulated thermal energy.

In thermography three approaches are known:

1. Imagewise transfer of an ingredient necessary for the chemical or physical process bringing about changes in colour or optical density to a receptor element.

2. Thermal dye transfer printing wherein a visible image pattern is formed by transfer of a coloured species from an imagewise heated donor element onto a receptor element.

3. Direct thermal formation of a visible image pattern by imagewise heating of a recording material containing matter that by chemical or physical process changes colour or optical density.

U.S. Pat. No. 3,080,254 discloses a typical heat-sensitive (thermographic) copy paper. Localized heating of the sheet in the thermographic reproduction process, or for test purposes by momentary contact with a metal test bar heated to a suitable conversion temperature in the range of about 90°–150° C., causes a visible change to occur in the heat-sensitive layer.

Thermographic materials of type 3 become photothermographic upon incorporating a photosensitive agent which after exposure to UV, visible or IR light is capable of catalyzing or participating in a thermographic process upon uniform heating to bring about changes in colour or optical density. U.S. Pat. No. 3,457,075 discloses a sheet material useful in imaging by a process involving exposure to a light-image followed by uniform heating.

During the production and use of thermographic and photo-thermographic recording materials electrostatic charging takes place when (photo)thermographic sheets move relative to one another in contact, as for example upon removal from a cassette, or are transported in frictional contact with low conductivity transport means, for example rubber rollers or belts, and when the support is transported in frictional contact with low conductivity transport means during the coating process(es) involved in the production thereof.

Build-up of charge on thermographic and photothermographic recording materials can be avoided by the incorporation of an antistatic layer.

U.S. Pat. No. 4,828,971 discloses a photothermographic or thermographic imaging element comprising a support bearing on a first side a photothermographic or thermographic imaging layer and, on the side of the support opposite the first side, a backing layer comprising the combination of (a) 0.25% to 60% by weight poly(silicic acid) represented by the formula:

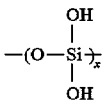

wherein x is an integer within the range of at least 3 to about 600 and (b) a water soluble hydroxyl containing polymer or monomer that is compatible with poly(silicic acid), enabling improved conveyance of the photothermographic or thermographic imaging element and reducing static electricity effects during manufacture.

U.S. Pat. No. 4,828,640 lays down the following set of requirements for backing layers suitable for use in thermally processable imaging elements:

a) should provide adequate conveyance characteristics during manufacturing steps;

b) should provide resistance to deformation of the element during thermal processing;

c) should enable satisfactory adhesion to the support of the element without undesired removal during thermal processing;

d) should be free from cracking and undesired marking, such as abrasion marking during manufacture, storage and processing of the element;

e) should reduce static electricity effects during manufacture; and f) should not cause undesired sensitometric effects in the element during manufacture, storage or processing.

To this list of requirements should be added that the antistatic layer should not be prohibitively coloured.

In U.S. Pat. No. 5,310,640 it is stated that "the meeting of all of these requirements with a single layer has proven to be extraordinarily difficult. While the backing layer of the U.S. Pat. No. 4,828,971 has excellent performance characteristics, its electrical conductivity is highly dependent on humidity. Under the very low humidity conditions involved in the high temperature processing chambers employed with thermally processable imaging elements, its conductivity is much too low to provide good protection against the effects of static."

The solution to this problem disclosed in U.S. Pat. No. 5,310,640 is to protect a conductive layer having an internal resistivity of less than $5\times10^{10}\Omega/\square$ with an outermost backing layer comprising a binder and a matting agent.

However, the presence of an outermost backing layer comprising a binder and a matting agent prevents an efficient electrical contact to materials in frictional contact therewith, it being such frictional contact with an insulating layer which results in the triboelectric charging responsible for the build-up of electrical charge.

EP-A 678 776 shows that it is possible to produce an antistatic outermost layer comprised of electrically-conductive metal-containing particles dispersed in a polymeric binder in an amount sufficient to provide a surface resistivity of less than $5\times10^{11}\Omega/\square$. However, conductivity in dispersions of such metal-containing particles in a polymeric binder is dependent upon the particles being extremely fine and their being uniformly distributed in the polymeric binder. Furthermore, such metal-containing particles are extremely hard and exhibit insufficient adhesion to the polymeric binder to avoid them being exposed on the antistatic layer surface where they will damage transporting belts and rollers leading to increased maintenance calls for belt and/or roller replacement.

It is therefore desirable to develop a single layer antistatic outermost backing layer in which the conductivity is not due to abrasive metal-containing particles, but with the characteristics listed above.

OBJECTS OF THE INVENTION

It is therefore an object of the present invention to provide a single layer antistatic outermost backing layer for thermographic and photothermographic recording materials not exhibiting prohibitive colour.

It is a further object of the present invention to provide a single layer antistatic outermost backing layer for thermographic and photothermographic recording materials exhibiting excellent adhesion to hydrophobic or hydrophobized supports.

It is a still further object of the present invention to provide a single layer antistatic outermost backing layer for thermographic and photothermographic recording materials exhibiting excellent abrasion resistance without abrading transport belts and rollers.

It is a yet further object of the present invention to provide a single layer antistatic outermost backing layer for thermographic and photothermographic recording materials coatable from an aqueous dispersion.

It is a yet further object of the present invention to provide a single layer antistatic outermost backing layer for thermographic and photothermographic recording materials with a conductivity independent of the ambient relative humidity.

Other objects and advantages of the present invention will become clear from the further description and examples

SUMMARY OF THE INVENTION

Surprisingly it has been found that a single layer antistatic outermost organic backing layer for thermographic and photothermographic recording materials with low colour, excellent adhesion, excellent abrasion resistance, low abrasion of transport belts and rollers, coatability from aqueous media and a relative humidity independent conductivity can be realized with a layer comprising an organic electrically conductive species such as polythiophene with conjugated backbone.

According to the present invention there is provided a thermographic recording material comprising a thermosensitive element, a support and an outermost antistatic layer, the thermosensitive element comprising a substantially light-insensitive organic silver salt, an organic reducing agent for the substantially light-insensitive organic silver salt in thermal working relationship therewith and a binder, characterized in that the outermost antistatic layer is an organic layer with a resistivity of $<10^{10}\Omega/\square$ at a relative humidity of 30%.

In a preferred embodiment of the thermographic recording material of the present invention, the outermost organic antistatic layer comprises a polythiophene with conjugated polymer backbone in the presence of a polymeric polyanion compound and a hydrophobic organic polymer having a glass transition value ($T_g$) of at least 40° C., the polythiophene being present at a coverage of at least 0.001 g/m$^2$ and the weight ratio of the polythiophene to the hydrophobic organic polymer being in the range of 1/10 to 1/1000.

Further according to the present invention a production method is provided for a thermographic recording material comprising the steps of: (i) coating one side of a support with a thermosensitive element comprising a substantially light-insensitive organic silver salt, an organic reducing agent for the substantially light-insensitive organic silver salt in thermal working relationship therewith and a binder; and (ii) coating one side of the thermosensitive element coated support with the above described outermost organic antistatic layer.

DETAILED DESCRIPTION OF THE INVENTION

Antistatic layer

In a preferred embodiment a production method is provided, wherein the outermost organic antistatic layer is coated from an aqueous dispersion or solution.

In another preferred embodiment the outermost organic antistatic layer is on the opposite side of the support to the thermosensitive element.

In still further preferred embodiment of the present invention a production method is provided for the thermographic recording material, comprising the step of coating the polythiophene antistatic layer from an aqueous dispersion of the hydrophobic organic polymer in the presence of an organic solvent or swelling agent for the hydrophobic organic polymer.

A preferred polythiophene for use according to the present invention contains thiophene nuclei substituted with at least one alkoxy group, e.g. $C_1$–$C_{12}$ alkoxy group or $-O(CH_2CH_2O)_nCH_3$ group, n being 1 to 4, or the thiophene nucleus is ring closed over two oxygen atoms with an alkylene group including such group in substituted form.

Examples of preferred polythiophenes for use according to the present invention are disclosed in U.S. Pat. No. 5,354,613. The preparation of the polythiophene and of aqueous polythiophene-polymeric polyanion dispersions containing the polythiophene is described in EP-A 440 957 and U.S. Pat. No. 5,354,613.

Suitable polymeric polyanion compounds for use in the presence of the polythiophenes prepared by oxidative polymerization are acidic polymers in free acid or neutralized form. The acidic polymers are preferably polymeric carboxylic or sulphonic acids. The weight ratio of polythiophene polymer to polymeric polyanion compound(s) can vary widely, for example from about 50/50 to 15/85.

The essential component of the outermost organic antistatic layer for providing the desired mechanical strength and adherence to an underlying hydrophobic resin support is the already mentioned hydrophobic dispersed polymer having a glass transition temperature (Tg) of at least 40° C. Suitable hydrophobic organic polymers used in dispersed form (latex form) in the coating composition according to the present invention are disclosed in U.S. Pat. No. 5,354,613.

In a preferred embodiment of the thermographic recording material of the present invention the aqueous coating composition the weight ratio of the polythiophene to the hydrophobic organic polymer is in the range of 1/20 to 1/100.

In order to obtain a stable uniformly coatable dispersion the coating composition according to the present invention contains a dispersing agent being a surface-active agent. Particularly suitable dispersing agents according to the present invention are anionic surfactants including a polyglycolether sulfate group.

The coherence of the antistatic layer and film-forming capability is improved by the presence in the coating composition according to the present invention of at least one organic liquid being a solvent or swelling agent for the hydrophobic polymer.

According to a preferred embodiment the organic solvent (s) or swelling agent(s) for the hydrophobic latex polymer are present in an amount of at least 50% by weight thereto.

The coating composition of the outermost organic layer may contain also matting agents and/or friction lowering substances, e.g. $TiO_2$ particles, colloidal silica, hydrophobized starch particles, fluor-substituted organic surface active agents (i.e. so-called fluortensides), wax particles and/or silicon resins and as spacing agents from the antistatic layer protruding polymer particles, as described e.g. in U.S. Pat. No. 4,059,768 and in U.S. Pat. No. 4,614,708.

According to particular embodiments the coating and drying of the antistatic layer composition may proceed before longitudinal stretching or between longitudinal and transversal stretching of a polyethylene terephthalate film web, wherein the stretching in transverse direction may be e.g. at a draw ratio of 2.5:1 to 4.0:1. When stretched the antistatic layer composition may contain stretch-improving agents as described e.g. in U.S. Pat. No. 4,089,997.

On drying the antistatic coating solvent(s) and water are removed by evaporation which may proceed at room temperature or at elevated temperature, e.g. in the range of 40° to 140° C.

After drying the thickness of a suitable antistatic layer prepared from a coating composition according to the present invention is e.g. from 0.05 to 50 μm, depending on the desired conductivity and transparency of the antistatic coating.

When used in thermographic materials the antistatic layer contains the hydrophobic organic polymer preferably at a coverage in the range of 0.05 to 5.00 g/m$^2$.

Antihalation layers

In a preferred embodiment, according to the present invention, the photothermographic recording material of the present invention further comprises an antihalation dye in a layer thereof. In a particularly preferred embodiment, according to the present invention, the antihalation dye is in a layer on the same side of the support as the photo-addressable thermosensitive element and/or in an outermost layer on the other side of the support. In an especially preferred embodiment of the present invention the outermost layer on the opposite side of the support to the photo-addressable thermosensitive element comprises an antihalation dye.

An antihalation layer has the function of absorbing light which has passed through the photosensitive layer, thereby preventing its reflection. The antihalation layer can be a layer of the photo-addressable thermosensitive element, another layer on the same side of the support as the photo-addressable thermosensitive element and/or a layer on the opposite side of the support to the photo-addressable thermosensitive element. Suitable anti-halation dyes for use with infra-red light are described in the EP-A's 377 961 and 652 473, the EP-B's 101 646 and 102 781 and the U.S. Pat. Nos. 4,581,325 and 5,380,635.

In a preferred embodiment of the present invention the anti-halation dye is a bis-indolenino-cyanine dye, with dyes according to general formulae (I), (II) and (III) being particularly preferred:

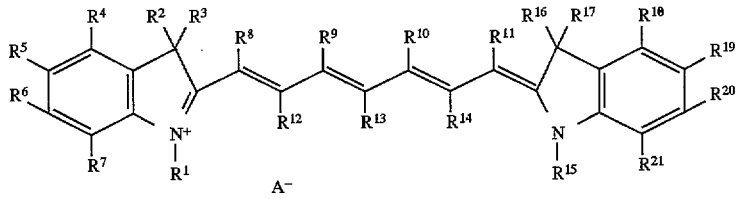

wherein $R^1$ and $R^{15}$ independently represent an alkyl group or an alkyl group substituted with at least one fluorine, chlorine, bromine or an alkoxy-, aryloxy- or ester-group; $R^2$, $R^3$, $R^{16}$ and $R^{17}$ independently represent an alkyl group; $R^4$, $R^5$, $R^6$, $R^7$, $R^{18}$, $R^{19}$, $R^{20}$ and $R^{21}$ independently represent hydrogen, chlorine, bromine, fluorine or a keto-, sulfo-, carboxy-, ester-, sulfonamide-, substituted sulfonamide-, amide-, substituted amide-, dialkylamino-, nitro-, cyano-, alkyl-, substituted alkyl-, alkenyl-, substituted alkenyl-, aryl-, substituted aryl-, alkoxy-, substituted alkoxy-, aryloxy- or substituted aryloxy-group, which groups may be substituted; or each of $R^4$ together with $R^5$, $R^5$ together with $R^6$, $R^6$ together with $R^7$, $R^{18}$ together with $R^{19}$, $R^{19}$ together with $R^{20}$ or $R^{20}$ together with $R^{21}$ may independently constitute the atoms necessary to complete a benzene ring which may be substituted; $R^8$, $R^9$, $R^{10}$ and $R^{11}$ independently represent hydrogen, an alkyl group or each of $R^1$ together with $R^8$, $R^8$ together with $R^9$, $R^9$ together with $R^{10}$, $R^{10}$ together with $R^{11}$ or $R^{11}$ together with $R^{15}$ may independently constitute the atoms necessary to complete a 5-atom or 6-atom carbocylic or heterocyclic ring which may be substituted; $R^{12}$, $R^{13}$ and $R^{14}$ independently represent hydrogen, chlorine, bromine or fluorine; and $A^-$ represents an anion;

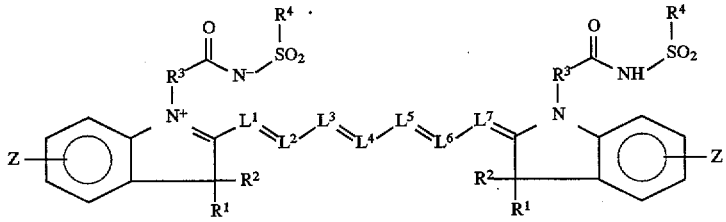

(II)

or an external salt thereof, wherein Z represents hydrogen, or one or more substituent(s), or the necessary atoms to complete a fused-on aromatic ring, e.g. phenylene, $R^1$ and $R^2$ each independently represent hydrogen or lower ($C_1$–$C_3$) alkyl which may be substituted; $R^3$ represents lower ($C_1$–$C_3$) alkylene which may be substituted; $R^4$ represents an alkyl or aryl group which may be substituted; each of $L^1$–$L^7$ represents a methine group which may be substituted, and the substituents of which may link together to form a supplementary ring which may be substituted itself; Y represents hydrogen or one or more substituent(s).

Cationic dyes according to formula (I) with hydrophobic anions can be loaded onto a polymer latex in an aqueous medium by adding with stirring a solution of the dye in an organic solvent to the polymer latex dispersion and then evaporating off the organic solvent.

The antihalation dyes represented by formulae (I), (II) and (III) described above are illustrated by the following examples, however, the scope of the present invention is not limited to them:
D01:
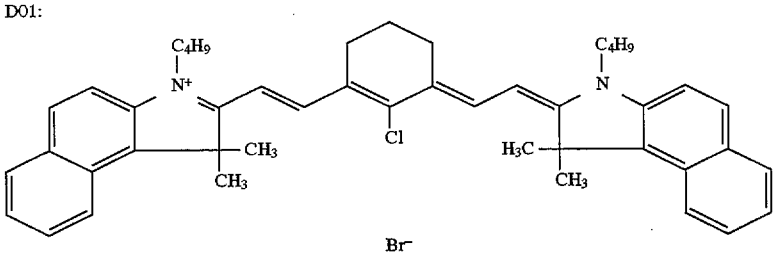
D02:
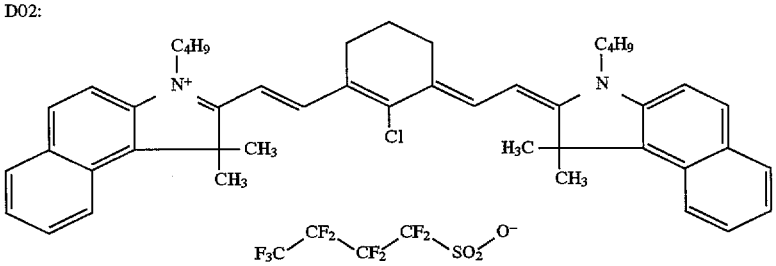
D03:
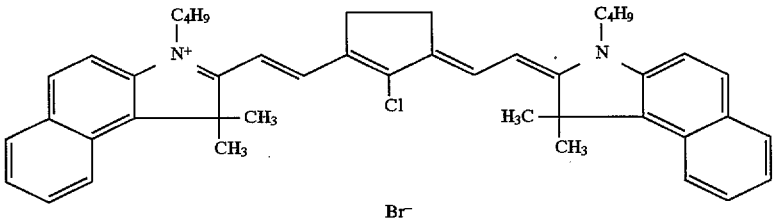
D04:
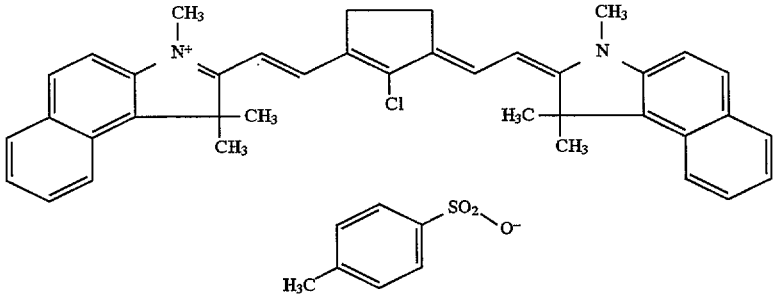
D05:
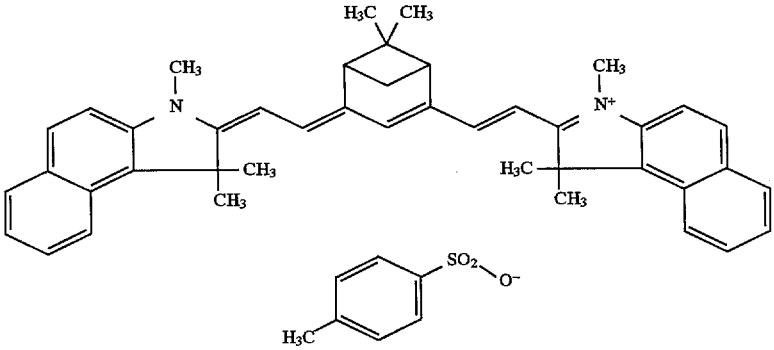

-continued
D06:
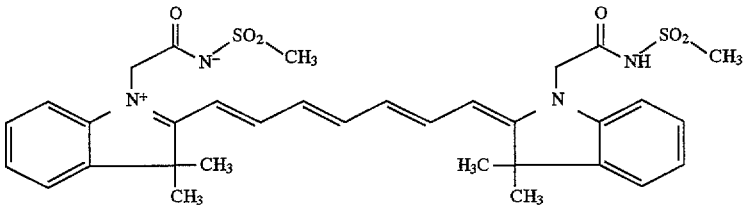
D07:
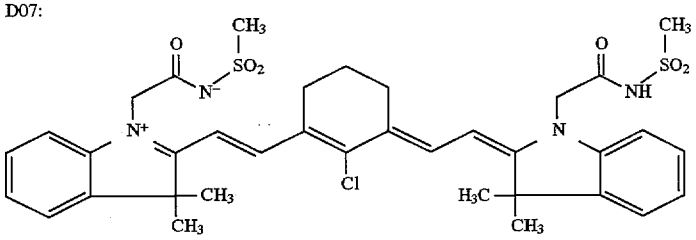
D08:
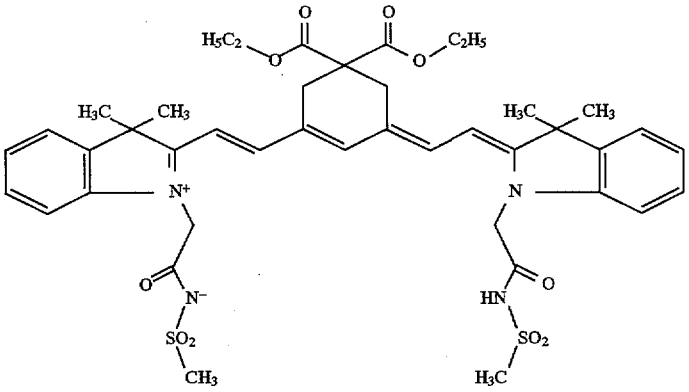
D09:
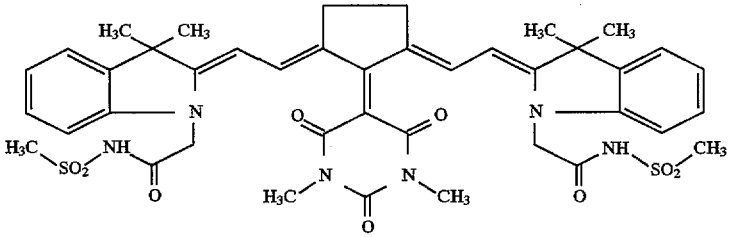
D10:
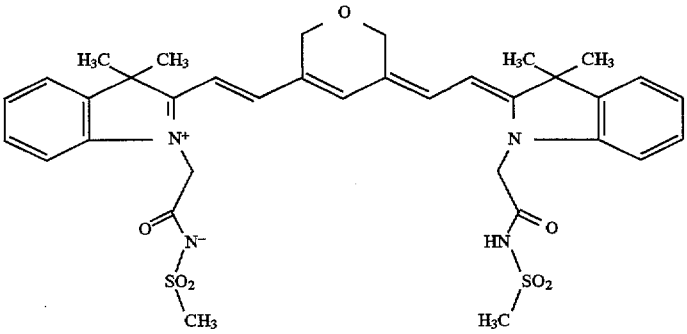

-continued
D11:
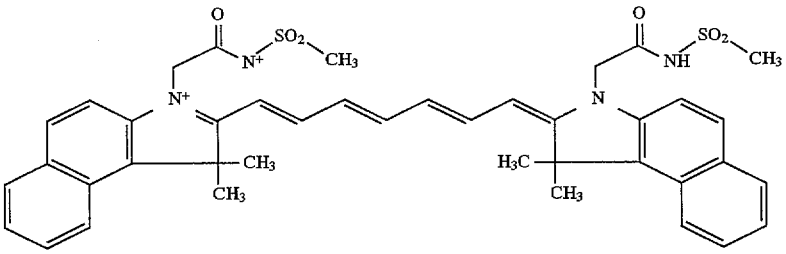
D12
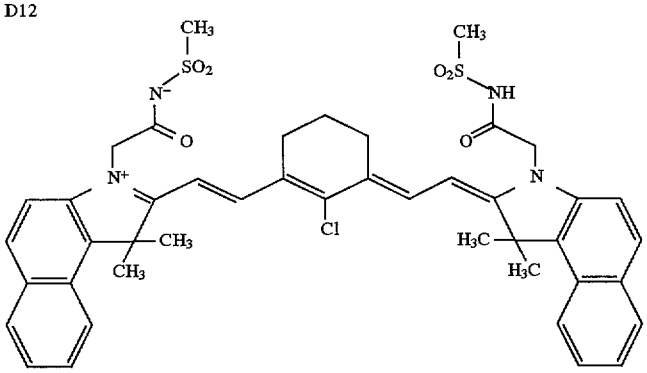
D13:
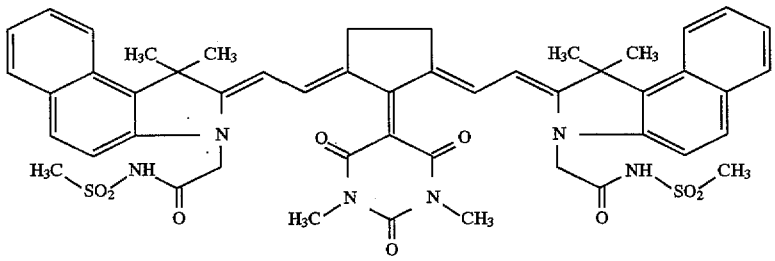
D14:
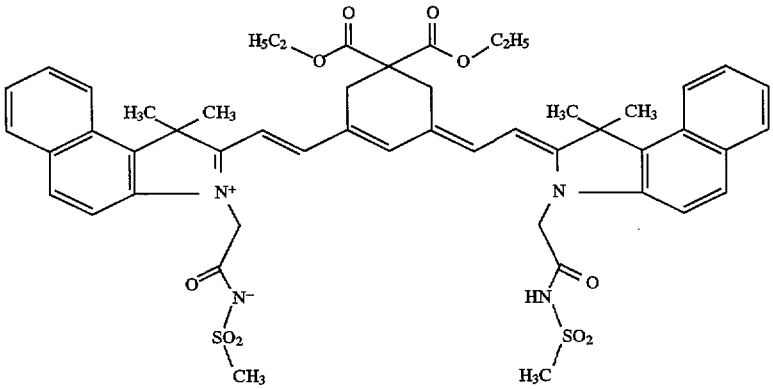

-continued

D15:

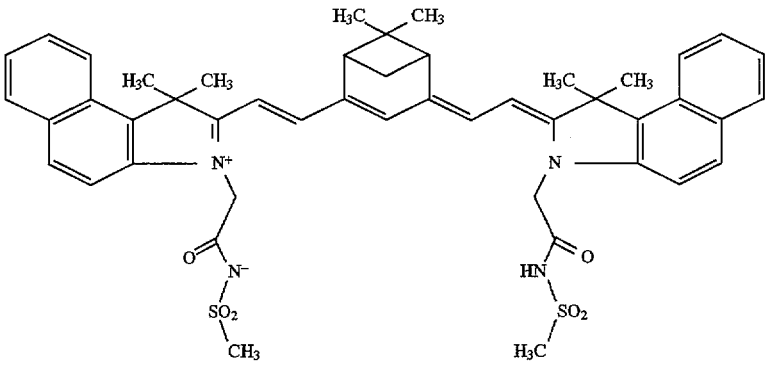

D16:

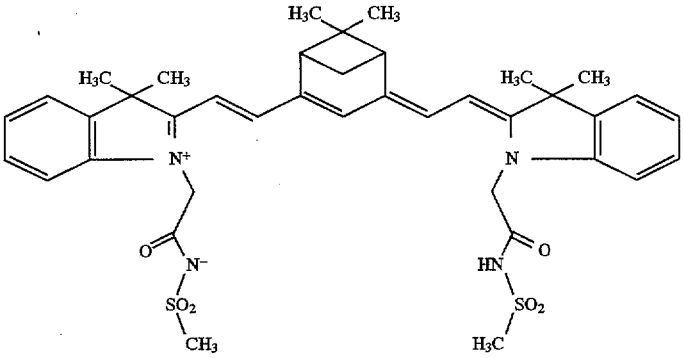

D17:

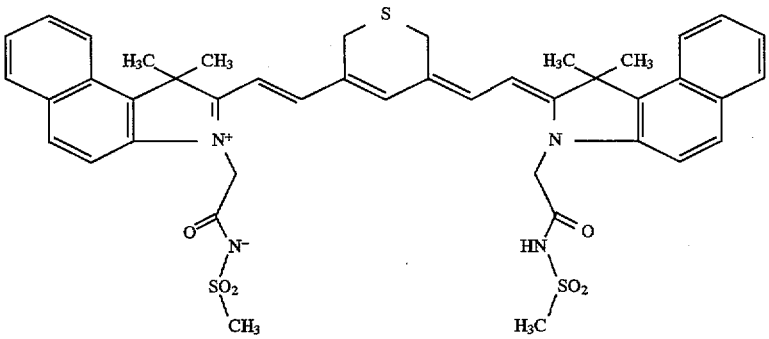

The general formulas and the actual examples of the infra-red absorbing compounds are written in their internal salt form. However, the compounds can also be used as external salts and these forms also belong to the scope of the present invention. Two different ways of salt formation are possible on the one hand, the —$N^-$— group of the —CO—$N^-$—$SO_2$—$R^4$ moiety of the left nucleus can be replaced by —NH—. $X^-$ wherein $X^-$ is a negative counterion, e.g. $Cl^-$, $Br^-$, etc. On the other hand, the —NH— group of the —CO—NH—$SO_2$—$R^4$ moiety can be replaced by —$N^-$—. $M^+$, wherein $M^+$ represents a cation such as $Na^+$ or $K^+$, or $(H.Base)^+$ such as $(H.triethylamine)^+$, $(H.pyridine)^+$, $(H.morpholine)^+$, $(H.DBU)^+$ (DBU=1,8-diazabicyclo-[5.4.0.]undec-7-ene, and $(H.DABCO)^+$, (DABCO=1,4-diazabicyclo-[2.2.2.]octane.

Other preferred antihalation dyes for use according to the present invention are the antihalation dyes of the general formula disclosed in EP-A 652 473 for use in hydrophilic antihalation layers, for example:

D18:

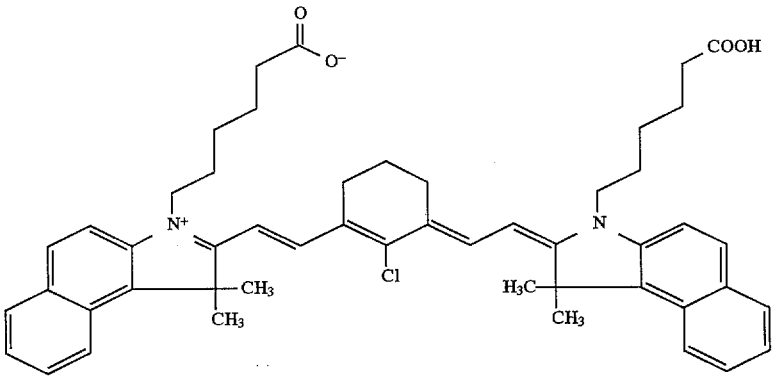

Thermosensitive element

The thermosensitive element, according to the present invention comprises a substantially light-insensitive organic silver salt and an organic reducing agent therefor in thermal working relationship therewith and a binder. The element may comprise a layer system in which the ingredients may be dispersed in different layers, with the proviso that the substantially light-insensitive organic silver salt and the organic reducing agent are in thermal working relationship with one another i.e. during the thermal development process the reducing agent must be present in such a way that it is able to diffuse to the substantially light-insensitive organic silver salt particles so that reduction of the organic silver salt can take place.

In a further embodiment, according to the present invention, the thermosensitive element further comprises photosensitive silver halide in catalytic association with the substantially light-insensitive organic silver salt or a component which is capable of forming photosensitive silver halide with the substantially light-insensitive organic silver salt.

Substantially light-insensitive organic silver salts

Preferred substantially light-insensitive organic silver salts for use according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Further useful substantially light-insensitive organic silver salts are described in U.S. Pat. No. 4,504,575, EP-A 227 141, GB-P 1,111,492, GB-P 1,439,478 and U.S. Pat. No. 4,260,677.

A suspension of particles containing a substantially light-insensitive organic silver salt may be obtained by using a process, comprising simultaneous metered addition of a solution or suspension of an organic compound with at least one ionizable hydrogen atom or its salt; and a solution of a silver salt to a liquid, as described in the unpublished European patent application number 95201968.5.

Reducing agents

Suitable organic reducing agents for the reduction of the substantially light-insensitive organic heavy metal salts are organic compounds containing at least one active hydrogen atom linked to O, N or C, such as is the case with, mono-, bis-, tris- or tetrakis-phenols; mono- or bis-naphthols; di- or polyhydroxy-naphthalenes; di- or polyhydroxybenzenes; hydroxymonoethers such as alkoxynaphthols, e.g. 4-methoxy-1-naphthol described in U.S. Pat. No. 3,094,41;,pyrazolidin-3-one type reducing agents, e.g. PHENIDONE (tradename); pyrazolin-5-ones; indan-1,3-dione derivatives; hydroxytetrone acids; hydroxytetronimides; 3-pyrazolines; pyrazolones; reducing saccharides; aminophenols e.g. METOL (tradename); p-phenylenediamines, hydroxylamine derivatives such as for example described in U.S. Pat. No. 4,082,901; reductones e.g. ascorbic acids; hydroxamic acids; hydrazine derivatives; amidoximes; n-hydroxyureas; and the like, see also U.S. Pat. Nos. 3,074,809, 3,080,254, 3,094,417 and 3,887,378.

Among useful aromatic di- and tri-hydroxy compounds having at least two hydroxy groups in ortho- or para-position on the same aromatic nucleus, e.g. benzene nucleus, hydroquinone and substituted hydroquinones, catechol, pyrogallol, gallic acid and gallic acid esters are preferred. Particularly useful are polyhydroxy spiro-bis-indane compounds, especially these corresponding to the following general formula (IV):

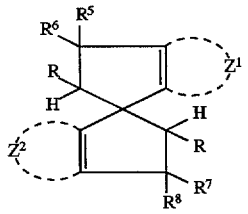

(IV)

wherein:

R represents hydrogen or alkyl, e.g. methyl or ethyl, each of $R^5$ and $R^6$ (same or different) represents, an alkyl group, preferably methyl group or a cycloalkyl group, e.g. cyclohexyl group, each of $R^7$ and $R^8$ (same or different) represents, an alkyl group, preferably methyl group or a cycloalkyl group, e.g. cyclohexyl group, and each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g an alkyl or aryl group.

Particularly preferred catechol-type reducing agents are described in EP-A 692 733.

Polyphenols such as the bisphenols used in the 3M Dry Silver™ materials, sulfonamide phenols such as used in the Kodak Dacomatic™ materials, and naphthols are particularly preferred for photothermographic recording materials with photo-addressable thermosensitive elements on the basis of photosensitive silver halide/organic silver salt/reducing agent.

Auxiliary reducing agents

The above mentioned reducing agents being considered as primary or main reducing agents may be used in conjunction with so-called auxiliary reducing agents. Such auxiliary reducing agents are e.g. sterically hindered phenols, that on heating become reactive partners in the reduction of the substantially light-insensitive organic heavy metal salt such as silver behenate, such as described in U.S. Pat. No. 4,001,026; or are bisphenols, e.g. of the type described in U.S. Pat. No. 3,547,648. The auxiliary reducing agents may be present in the imaging layer or in a polymeric binder layer in thermal working relationship thereto.

Preferred auxiliary reducing agents are sulfonamidophenols corresponding to the following general formula

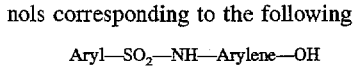

$$\text{Aryl—SO}_2\text{—NH—Arylene—OH}$$

in which:

Aryl represents a monovalent aromatic group, and

Arylene represents a bivalent aromatic group, having the —OH group preferably in para-position to the —$SO_2$—NH— group.

Other auxiliary reducing agents that may be used in conjunction with the above mentioned primary reducing agents are disclosed in U.S. Pat. No. 5,464,738, U.S. Pat. No. 5,496,695, U.S. Pat. No. 3,460,946 and U.S. Pat. No. 3,547,648.

Film-forming binders for thermosensitive element

The film-forming binder of the thermosensitive element containing the substantially light-insensitive organic silver salt may be solvent soluble or solvent dispersible or may be water soluble or water dispersible.

Film-forming binders of all kinds of natural, modified natural or synthetic resins or mixtures of such resins, wherein the organic silver salt can be dispersed homogeneously are suitable: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals, copolymers of acrylonitrile and acrylamide, polyacrylic acid esters, polymethacrylic acid esters, polystyrene and polyethylene or mixtures thereof.

The film-forming binders suitable for thermosensitive elements coated from aqueous dispersions may be all kinds of transparent or translucent water-dispersible or water soluble natural, modified natural or synthetic resins or mixtures of such resins, wherein the organic silver salt can be dispersed homogeneously for example proteins, such as gelatin and gelatin derivatives (e.g. phthaloyl gelatin), cellulose derivatives, such as carboxymethylcellulose, polysaccharides, such as dextran, starch ethers etc., polyvinyl alcohol, polyvinylpyrrolidone, acrylamide polymers, homo- or co-polymerized acrylic or methacrylic acid, latexes of water dispersible polymers, with or without hydrophilic groups, or mixtures thereof. Polymers with hydrophilic functionality for forming an aqueous polymer dispersion (latex) are described e.g. in U.S. Pat. No. 5,006,451, but serve therein for forming a barrier layer preventing unwanted diffusion of vanadium pentoxide present as an antistatic agent.

The above mentioned binders or mixtures thereof may be used in conjunction with waxes or "heat solvents" also called "thermal solvents" or "thermosolvents" improving the reaction speed of the redox-reaction at elevated temperature.

Polycarboxylic acids and anhydrides thereof

According to the recording material of the present invention the thermosensitive element may comprise in addition at least one polycarboxylic acid and/or anhydride thereof in a molar percentage of at least 20 with respect to all the organic silver salt(s) present and in thermal working relationship therewith.

Preferred saturated aliphatic dicarboxylic acids are those containing at least 4 carbon atoms, e.g. adipic acid and pimelic acid. Preferred aromatic polycarboxylic acids are ortho-phthalic acid and tetrachlorophthalic acid and the anhydrides thereof.

Toning agent

In order to obtain a neutral black image tone in the higher densities and neutral grey in the lower densities the (photo) thermographic recording layer contains preferably in admixture with the organic heavy metal salts and reducing agents a so-called toning agent known from thermography or photothermography.

Suitable toning agents are succinimide, phthalazine and the phthalimides and phthalazinones within the scope of the general formulae described in U.S. Pat. No. 4,082,901. Further suitable toning agents are described in U.S. Pat. Nos. 3,074,809, 3,446,648 and 3,844,797. Other particularly useful toning agents are the heterocyclic toner compounds of the benzoxazine dione or naphthoxazine dione type described in GB-P 1,439,478 and U.S. Pat. No. 3,951,660 with the toning agent benzo[e] [1,3]oxazine-2,4-dione being particularly suitable for use in combination with polyhydroxy benzene reducing agents.

Photosensitive silver halide

The photosensitive silver halide used in the present invention may be employed in a range of 0.75 to 25 mol percent and, preferably, from 2 to 20 mol percent of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

Emulsion of organic silver salt and photosensitive silver halide

A suspension of particles containing a substantially light-insensitive silver salt of an organic carboxylic acid may be obtained by using a process described in the unpublished European patent application number 95201968.5.

The silver halide may be added to the photo-addressable themosensitive element in any fashion which places it in catalytic proximity to the substantially light-insensitive organic silver salt. A particularly preferred mode of preparing the emulsion of organic silver salt and photosensitive silver halide for coating of the photo-addressable thermally developable element from solvent media, according to the present invention is that disclosed in U.S. Pat. No. 3,839,049, but other methods such as those described in Research Disclosure, June 1978, item 17029 and U.S. Pat. No. 3,700,458 may also be used for producing the emulsion.

Spectral sensitizer

The photo-addressable thermosensitive element of the photothermographic recording material, according to the present invention, may contain a spectral sensitizer, optionally together with a supersensitizer, for the silver halide. Suitable sensitizers of silver halide to infra-red radiation include those disclosed in the EP-A's 465 078, 559 101, 616 014 and 635 756, the JN's 03-080251, 03-163440, 05-019432, 05-072662 and 06-003763 and the U.S. Pat. Nos. 4,515,888, 4,639,414, 4,713,316, 5,258,282 and 5,441,866. Suitable supersensitizers for use with infra-red spectral sensitizers are disclosed in EP-A's 559 228 and 587 338 and in the U.S. Pat. Nos. 3,877,943 and 4,873,184.

Colloidal particles comprising silicon dioxide

In a preferred embodiment of the present invention, the thermosensitive element comprises a layer comprising at least one substantially light-insensitive organic silver salt in at least one binder and in thermal working relationship therewith an organic reducing agent therefor, the layer further containing colloidal particles comprising silicon dioxide at a coating weight given by expression (1):

$$0.015 \times \frac{B}{AGOS} < \frac{S}{AGOS} < 1.2\left(\frac{B}{AGOS} - 0.4\right) \quad (1)$$

wherein B represents the total weight of all binders in the layer, AGOS represents the total weight of all organic silver salts in the layer and S represents the weight of the colloidal particles in the layer.

Preferred types of colloidal particles comprising silicon dioxide are those that are hydrophobized thereby making them readily dispersible in the binders of the layer comprising at least one light-insensitive organic silver salt without substantially reducing the transparency of the recording layer of the present invention.

Preferred types of colloidal particles comprising silicon dioxide, according to the present invention, have specific surface areas of less than 100 $m^2/g$.

Particularly preferred types of colloidal particles comprising silicon dioxide, according to the present invention, are hydrophobized grades of amorphous flame hydrolyzed silica for example Aerosil™ R812 and Aerosil™ R972 from Degussa AG.

Other additives

In addition to the ingredients the (photo-addressable) thermosensitive element may contain other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Öl A (tradename of BAYER AG-GERMANY), ultraviolet light absorbing compounds, white light reflecting and/or ultraviolet radiation reflecting pigments, fine polymeric particles [e.g. of poly (methylmethacrylate)] and/or optical brightening agents.

Support

The support for the thermographic recording material according to the present invention may be transparent, translucent or opaque, e.g. having a white light reflecting aspect and is preferably a thin transparent resin film, e.g. cellulose triacetate, corona and flame treated polypropylene, polystyrene, polymethacrylic acid ester, polycarbonate or polyester, e.g. polyethylene terephthalate or polyethylene naphthalate as disclosed in GB 1,293,676, GB 1,441,304 and GB 1,454,956. Should a transparent base be used, the base may be colourless or coloured, e.g. having a blue colour.

The support may be in sheet, ribbon or web form and subbed or pretreated, if need be to improve the adherence to the thereon coated thermosensitive element and antistatic outermost organic backing layer.

Suitable subbing layers for improving the adherence of the thermosensitive element and the antistatic outermost organic backing layer of the present invention for polyethylene terephthalate supports are described e.g. in GB-P 1,234,755, U.S. Pat. Nos. 3,397,988; 3,649,336; 4,123,278 and U.S. Pat. No. 4,478,907 and in Research Disclosure, July 1967, p. 6. Suitable pretreatments of hydrophobic resin supports are, for example, treatment with a corona discharge and/or attack by solvent(s), thereby providing a microroughening.

Outermost layer on same side of support as thermosensitive element

The outermost layer of the recording material on the same side of the support as the thermosensitive element may in different embodiments of the present invention be the outermost layer of the (photo-addressable) thermosensitive element or a protective layer applied to the (photo-addressable) thermosensitive element.

Lubricants for outermost layer on same side of support as thermosensitive element According to a preferred embodiment of the present invention, the thermosensitive element is provided with an outermost layer, which is not the outermost organic antistatic layer, comprising at least one solid lubricant having a melting point below 150° C. and at least one liquid lubricant in a binder, wherein at least one of the lubricants is a phosphoric acid derivative.

Suitable solid lubricants, according to the present invention, have a melting point below 150° C. Preferred are solid lubricants having a melting point below 110° C., with solid lubricants with a molecular weight below 1000 being particularly preferred. For the purposes of the present invention solid lubricants are defined as those lubricants being solid at room temperature.

Solid lubricants which can be used according to the present invention are polyolefin waxes e.g. polypropylene waxes, ester waxes e.g. fatty acid esters, polyolefin-polyether block copolymers, amide waxes e.g. fatty acid amides, polyglycols e.g. polyethylene glycol, fatty acids, fatty alcohols, natural waxes and solid phosphoric acid derivatives. Preferred solid lubricants are fatty acid esters, polyolefin-polyether block copolymers and fatty acid amides.

Hydrophilic binder for outermost layer on same side of support as thermosensitive layer According to an embodiment of the present invention the outermost layer of the thermographic recording material may comprise a hydrophilic binder. Suitable hydrophilic binders for the outermost layer are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

Crosslinking agents for outermost layer on same side of support as thermosensitive layer The outermost layer of the thermographic recording material, according to the present invention, may be crosslinked. Crosslinking is preferred when the outermost layer comes into contact with a thermal head. This can be achieved by using crosslinking agents such as described in WO 95/12495 for protective layers, e.g. tetraalkoxysilanes, polyisocyanates, zirconates, titanates, melamine resins etc., with tetraalkoxysilanes such as tetramethylorthosilicate and tetraethylorthosilicate being preferred.

Matting agents for outermost layer on same side of support as thermosensitive layer The outermost layer of the (photo)thermographic recording material according to the present invention may comprise a matting agent. Suitable matting agents are described in WO 94/11198 and include e.g. talc particles and optionally protrude from the outermost layer.

Protective layer

The outermost layer surface layer of the (photo) thermographic recording material according to the present invention may be a protective layer applied to the (photo-addressable) thermosensitive element to avoid local deformation of the (photo-addressable) thermosensitive element and to improve resistance against abrasion.

The protective layer preferably comprises a binder, which may be hydrophobic (solvent soluble) of hydrophilic (water soluble). Among the hydrophobic binders polycarbonates as described in EP-A 614 769 are particularly preferred. However, hydrophilic binders are preferred for the protective layer, as coating can be performed from an aqueous composition and mixing of the hydrophilic protective layer with the immediate underlayer can be avoided by using a hydrophobic binder in the immediate underlayer.

Coating

The coating of any layer of the (photo)thermographic recording materials of the present invention may proceed by any thin-film coating technique known in the art. In the coating of web type supports for photographic materials slide hopper coating is used advantageously, but other coating techniques such as dip coating and air knife coating may also be used. Details about such coating techniques can be found in "Modern Coating and Drying Technology" by Edward D. Cohen and Edgar B. Gutoff, published by VCH Publishers, Inc. 220 East 23rd Street, Suite 909 New York, N.Y. 10010.

Processing configurations for thermographic recording materials

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In a particular embodiment of the method according to the present invention the direct thermal image-wise heating of the recording material proceeds by Joule effect heating in that selectively energized electrical resistors of a thermal head array are used in contact or close proximity with the recording layer. Suitable thermal printing heads are e.g. a Fujitsu Thermal Head (FTP-040 MCS001), a TDK Thermal Head F415 HH7-1089 and a Rohm Thermal Head KE 2008-F3.

Activation of the heating elements can be power-modulated or pulse-length modulated at constant power.

When used in thermographic recording operating with thermal printheads the recording materials will not be suited for reproducing images with fairly large number of grey levels as is required for continuous tone reproduction. EP-A 622 217 discloses a method for making an image using a direct thermal imaging element with improved continuous tone reproduction.

Recording process for (photo)thermographic recording materials

A thermographic recording process, according to a preferred embodiment of the present invention, comprises the steps of: (i) bringing an outermost layer of the above described thermographic recording material into contact with a heat source; (ii) applying heat from the heat source imagewise to the thermographic recording material while maintaining mutual contact to but with relative movement between the thermographic recording material and the heat source; and (iii) separating the thermographic recording material from the heat source and in particular wherein the outermost layer in contact with said heat source is not the outermost organic antistatic layer and the maximum dynamic frictional coefficient during the contact between the outermost layer in contact with the heat source and the heat source is less than 0.3.

Photothermographic recording materials, according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating with for example a heated roller or a thermal head, radiative heating, microwave heating etc.

Applications

The thermographic and photothermographic recording materials of the present invention can be used for both the production of transparencies and reflection type prints. This means that the support will be transparent or opaque, e.g. having a white light reflecting aspect. Should a transparent bmse be used, the base may be colourless or coloured, e.g. has a blue colour.

In the hard copy field recording materials on a white opaque base are used, whereas in the medical diagnostic field black-imaged transparencies are widely used in inspection techniques operating with a light box.

Application of the present invention is envisaged in the fields of both graphics images requiring high contrast images with a very steep print density applied dot energy dependence and continuous tone images requiring a weaker print density applied dot energy dependence, such as required in the medical diagnostic field. Direct thermal imaging can be used f or both the production of transparencies and reflection type prints.

Characterization of outermost backside organic antistatic layer

The surface resistance expressed in ohm/square (Ω/□) of the above defined antistatic layer is measured according to test procedure A as follows: after coating, the resulting antistatic layer is dried and conditioned at a specific relative humidity (RH) and temperature. The surface resistance expressed in ohm per square (Ω/□) is determined by placing two 10 cm long conductive poles, parallel to one another and at a distance of 1 cm from each other, onto the outermost organic backside layer and measuring the resistance built up between the electrodes with a precision ohm-meter (ref. DIN 53482).

According to test procedure B (described in the periodical Research Disclosure—June 1992, item 33840) the resistance of the layer assemblage is measured contactless by placing it between capacitor plates which are part of a RC-circuit differentiator network. The dimensions of the measurement cell are chosen in such a way that from the known capacitor value (C) it is possible using the measured RC-value to calculate the electrical resistance of the layer assemblage. An electrical pulse is introduced into the measurement circuit and the discharge curve recorded, from which the time $\tau=R\times C$ at which the applied charge and voltage of the electrical pulse have dropped to 1/e multiples of their initial values is obtained in milliseconds (msec) (where e is the base number of the natural logarithm). By regarding the RC circuit as a high frequency band pass filter, the resistance can be determined from the alternating current voltage frequency (f), the cut-off frequency, at which a 3 dB signal is obtained, using the expression: $f=\frac{1}{2\pi}\times R\times C$. The lower the value of $\tau$ the better the antistatic character or charge mobility of the antistatic layer.

The following ingredients were used in the INVENTION and COMPARATIVE EXAMPLES:

antistatic layer ingredients:

KELZAN™ S: a xanthan gum from MERCK & CO., Kelco Division, USA, which according to Technical Bulletin DB-19 is a polysaccharide containing mannose, glucose and glucuronic repeating units as a mixed potassium, sodium and calcium salt;

PT-dispersion: a 1.2% dispersion of poly(3,4-ethylenedioxy-thiophene)/polystyrene sulphonic acid produced by the polymerization of 3,4-ethylenedioxy-thiophene in the presence of polystyrene sulphonic acid and ferric sulphate as described in U.S. Pat. No. 5,354,613;

PERAPRET™ PE40: 40% aqueous dispersion of polyethylene latex from BASF;

MAT01: 5.71% aqueous dispersion of particles of crosslinked polymethylmethacrylate particles having an average particle size of 3 μm produced as described in EP-A 466 982;

MAT02: 20% aqueous dispersion of crosslinked methylmethacrylate (98% by weight)—stearylmethacrylate (2% by weight)-copolymeric beads with an average particle size of 5.9 μm produced as described in U.S. Pat. No. 4,861,812;

LATEX01: a 12% by weight dispersion of polymethyl methacrylate with an average particle size of 88.8 nm prepared as described in U.S. Pat. No. 5,354,613;

LATEX02: a 20% by weight dispersion of polymethyl methacrylate with an average particle size of 88.8 nm prepared as described in U.S. Pat. No. 5,354,613;

thermosensitive element:

i) silver behenate emulsion layer:

AgBeh: silver behenate;

PVB: polyvinyl butyral (BUTVAR™ B79);

R1: butyl 3,4-dihydroxybenzoate;

TA1: benzo[e] [1,3]oxazine-2,4-dione;

Oil: silicone oil (Baysilone™ from Bayer AG);

S1: tetrachlorophthalic anhydride;

S2: pimelic acid;

R812: hydrophobic silicon dioxide (Aerosil™ R812 from Degussa);

ii) protective layer:

| | | Melting point [°C.] |
|---|---|---|
| PSL01: | Servoxyl ™ VPAZ 100 from Servo Delden BV (mixture of monolauryl and dilauryl phosphates) | 33 |
| PLL01: | Servoxyl ™ VPDZ 3 100 from Servo Delden BV {mono[isotridecyl polyglycolether (3 EO)]phosphate | |
| SL01: | ethylenebisstearamide (Ceridust ™ 3910 from HOECHST) | 141 |
| SL02: | erucamide | 80 |
| LL01: | Tegoglide ™ ZG 400 from TEGO-chemie | |

where

PSL=solid phosphoric acid derivative lubricant

PLL=liquid phosphoric acid derivative lubricant

SL=solid non-phosphoric acid derivative lubricant

LL=liquid non-phosphoric acid derivative lubricant photo-addressable thermosensitive element:

i) silver behenate/silver halide emulsion layer:

GEL: phthaloylgelatin, type 16875 from ROUSSELOT;

Butvar™ B76: polyvinylbutyral from MONSANTO;

LOWINOX™ 22IB46: 2-propyl-bis(2-hydroxy-3,5-dimethylphenyl)methane from CHEM. WERKE LOWI;

PHP: pyridinium hydrobromide perbromide;

CBBA: 2-(4-chlorobenzoyl)benzoic acid;

TMPS: tribromomethyl benzenesulfinate;

MBI: 2-mercaptobenzimidazole;

SENSI:

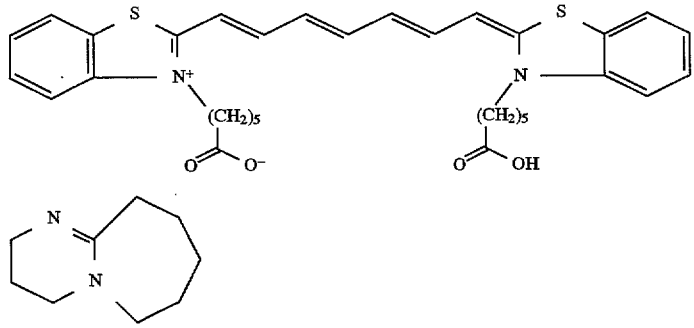

ii) protective layer:

CAB: cellulose acetate butyrate, CAB-171-15S from EASTMAN;

PMMA: polymethylmethacrylate, Acryloid™ K120N from ROHM & HAAS.

The following examples illustrate the present invention without however limiting it thereto. All percentages, parts and ratios are by weight unless otherwise mentioned.

INVENTION EXAMPLES 1 to 4

A 0.34 mm transparent blue polyethylene terephthalate sheet was coated on both sides to a thickness of 0.1 mm with a subbing layer composition which after drying and longitudinal and transverse stretching produced a 175 μm thick support coated on both sides with the following subbing-layer composition expressed as the coating weights of the ingredients present:

# terpolymer latex of vinylidene chloride/methyl acrylate/itaconic acid (88/10/2): 0.16 g/m$^2$ # colloidal silica: 0.04 g/m$^2$
# alkyl sulfonate surfactant: 0.6 mg/m$^2$
# aryl sulfonate surfactant: 4 mg/m$^2$ Outermost backside organic antistatic layer The 175 μm thick biaxially stretched polyethylene terephthalate support was then coated on one side with the different backside layer compositions given in table 1.

TABLE 1

| Composition of layer of invention example no. | KELZAN™ S [g] | $H_2O$ [ml] | 1-methyl-2-pyrrolidone [ml] | PT-dispersion [ml] | LATEX 02 [ml] | MAT01 [ml] |
|---|---|---|---|---|---|---|
| 1 | 0.15 | 888 | 20 | 48 | 43 | 0.53 |
| 2 | 0.15 | 878 | 30 | 48 | 43 | 0.53 |
| 3 | 0.15 | 868 | 40 | 48 | 43 | 0.53 |
| 4 | 0.30 | 910 | 22.5 | 37.5 | 30 | 0.05 |

These compositions were produced by first stirring the KELZAN™ S in the deionized water until a uniform emulsion was obtained, adding 0.67 ml of 25% ammonium hydroxide/g KELZAN™ S followed by stirring for 20 minutes and finally with stirring adding the N-methylpyrrolidone, the PT-dispersion, the LATEX02 and the MAT01, a matting agent dispersion. Each of the compositions of INVENTION EXAMPLES 1 to 4 was coated at 30 m$^2$/l and dried at 120° C.

The measurements of surface resistivity (SR in Ω/□) and charge mobility (represented by discharging time τ=RC in msec) of the antistatic layers obtained were carried out as described above. The samples were conditioned at 20° C. and 30% relative humidity prior to these measurements. The results are given in Table 2.

TABLE 2

| Layer of invention example number | Surface resistivity SR [Ω/□] | RC constant τ |
|---|---|---|
| 1 | $1.7 \times 10^8$ | 0.049 |
| 2 | $6.3 \times 10^8$ | 0.23 |
| 3 | $1.1 \times 10^9$ | 0.36 |
| 4 | $1.2 \times 10^7$ | |

The results in Table 2 show that the matting agent has little effect on the antistatic properties of the outermost organic backside antistatic layer of the present invention.

INVENTION EXAMPLES 5 to 10

Outermost backside organic antistatic layer

The 175 μm thick biaxially stretched polyethylene support produced as described in INVENTION EXAMPLES 1 to 4 was coated with different backside compositions which after drying at 130° C. produced the following layer compositions, expressed as the coating weights of the ingredients present:

# polysaccharide (KELZAN™ S): 10 mg/m$^2$
# polyethylenedioxythiophene: 5 mg/m$^2$
# polystyrene sulfonic acid: 10 mg/m$^2$
# aryl sulfonate surfactant (ULTRAVON™ W from CIBA-GEIGY): 21 mg/m$^2$
# polyethylene wax (PERAPRET™ PE40): 10 mg/m$^2$
# polymethylmethacrylate latex (LATEX02): 200 mg/m$^2$ together with the polymer beads and colloidal silica (Kieselsol™ 100F from BAYER) as specified with the surface resistance results of the layers in table 3.

TABLE 3

| Invention example number | Coating wt. of Kieselsol 100F [mg/m$^2$] | Coating weight of MAT02 [mg/m$^2$] | Surface resistivity at 30% RH [Ω/□] |
|---|---|---|---|
| 5 | 20 | — | $5 \times 10^6$ |
| 6 | 70 | — | $5 \times 10^6$ |
| 7 | 20 | 6 | $1 \times 10^7$ |
| 8 | 20 | 30 | $8 \times 10^6$ |
| 9 | 70 | 6 | $7 \times 10^6$ |
| 10 | 70 | 30 | $7 \times 10^6$ |

Thermosensitive element

The subbed polyethylene terephthalate support having a thickness of 175 μm was doctor blade-coated on the side not coated with the backside layers with a coating composition containing 2-butanone as solvent so as to obtain thereon, after drying for 1 hour at 50° C., a thermosensitive element with the following composition:

# silver behenate: 4.90 g/m$^2$
# polyvinyl butyral (Butvar™ B79 from MONSANTO): 19.62 g/m$^2$
# silicone oil (Baysilon™ MA from BAYER): 0.045 g/m$^2$
# benzo[e] [1,3]oxazine-2,4-dione: 0.268 g/m$^2$
7-(ethylcarbonato)benzo[e] [1,3]oxazine-2,4-dione: 0.138 g/m$^2$
ethyl 3,4-dihydroxybenzoate: 1.003 g/m$^2$
# adipic acid: 0.352 g/m$^2$
# benzotriazole: 0.130 g/m$^2$ Protective layer The thermosensitive element was then coated with an aqueous composition. The pH of the coating composition was adjusted to a pH of 4 by adding 1N nitric acid. Those lubricants which were insoluble in water, were dispersed in a ball mill with, if necessary, the aid of a dispersion agent. The composition was coated to a wet layer thickness of 85 μm and then dried at 40° C. for 15 minutes and hardened at 57° C. and a relative humidity of 34% for 2 days to produce a layer with the following composition expressed as the coating weight of the ingredients present:

# polyvinylalcohol (Mowiviol™ WX 48 20, Wacker Chemie): 4.9 g/m$^2$
# dispersion agent (Ultravon™ W from Ciba Geigy)*: 0.075 g/m$^2$
# colloidal silica (Levasil™ VP AC 4055 from Bayer AG, a 15% aqueous dispersion of colloidal silica): 1.05 g/m$^2$
PLL01: 0.075 g/m$^2$

PSL01: 0.075 g/m$^2$
# talc (Steamic™ OOS from Talc de Lusenac): 0.045 g/m$^2$
# porous silica (Syloid™ 72 from Grace): 0.09 g/m$^2$
# glycerine monotallow acid ester (Rilanit™ GMS from Henkel): 0.15 g/m$^2$
# tetramethylorthosilicate (hydrolyzed in the presence of methanesulfonic acid): 0.87 g/m$^2$
* converted into acid form by passing through an ion exchange column Thermographic printing The thermographic recording materials of INVENTION EXAMPLES 5 to 10 were printed using a DRYSTAR™ 2000 printer (from AGFA-GEVAERT) at an average printing power of 63 mW/dot. The printed images obtained all exhibited maximum densities, measured through a visual filter with a Macbeth™ TR924 densitometer, between 3.00 and 3.40 and minimum densities below 0.10.

The colour neutrality the optical density (D) of these printed images was evaluated by measuring the optical densities through blue, green and red filters using a MacBeth™ TR924 densitometer. The lowest, next highest and highest optical densities were assigned to $D_1$, $D_2$ and $D_3$ respectively and were used to obtain a numerical colour value (NCV) by substituting the corresponding values in the following equation:

$$NCV = \frac{D_1 \times D_2}{(D_3)^2}$$

Maximal colour neutrality corresponds to a NCV value of 1. NCV-values well above 0.90 were observed throughout the optical density range with all the printed images, indicating a neutral grey tone.

The uniformity of the printed images was excellent at all optical density levels between the maximum and minimum densities i.e. no pinholes were present.

INVENTION EXAMPLES 11 to 13

A subbed polyethylene terephthalate support having a thickness of 175 μm was doctor blade-coated, on the side of the support opposite to that on which an antistatic layer prepared as described for INVENTION EXAMPLE 7 had been coated, from a coating composition containing butanone as a solvent and the following ingredients so as to obtain thereon, after drying for 1 hour at 50° C., layers with the compositions given in table 4.

TABLE 4

| Invention example number | AgBeh [g/m$^2$] | PVB [g/m$^2$] | PVB AgBeh | $SiO_2$ AgBeh | R1 [g/m$^2$] | TA1 [g/m$^2$] | Oil [g/m$^2$] | S1 [g/m$^2$] | S2 [g/m$^2$] | R812 [g/m$^2$] |
|---|---|---|---|---|---|---|---|---|---|---|
| 11 | 5.40 | 16.20 | 3 | 0.4 | 1.275 | 0.392 | 0.0491 | 0.173 | 0.563 | 2.160 |
| 12 | 5.19 | 15.57 | 3 | 0.75 | 1.228 | 0.377 | 0.0473 | 0.166 | 0.542 | 3.892 |
| 13 | 5.53 | 15.29 | 3 | 1 | 1.307 | 0.402 | 0.0504 | 0.177 | 0.578 | 5.532 |

Thermographic printing

The printer used for evaluating the thermographic recording materials of INVENTION EXAMPLE 5 to 10 was used. During printing the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving the ribbon with a total thickness of 6 μm.

image evaluation

The optical maximum and minimum densities of the prints given in table 5 were measured through a visual filter with a Macbeth™ TD904 densitometer in the grey scale step corresponding to data levels of 255 and 0 respectively.

For evaluating the tone reproduction capabilities of the thermosensitive recording materials of INVENTION EXAMPLES 11 to 13, the numerical gradation value (NGV) corresponding to the expression: $(2.5-0.06)/(E_{2.5}-E_{0.06})$ was determined; where $E_{2.5}$ is that energy in Joule applied to a dot area of 87 μm×87 μm of the recording material required to obtain an optical density value of 2.5 as measured with a Macbeth™ TD904 densitometer, and $E_{0.06}$ is that energy in Joule applied to a dot area of 87 μm×87 μm of the recording material required to obtain an optical density value of 0.06 as measured with a Macbeth™ TD904 densitometer. The applied energy in Joule is actually the electrical input energy measured for each resistor of the thermal head.

The colour neutrality of the optical density (D) of the obtained images was measured as described for the evaluation of the thermographic images obtained with the thermographic recording materials of INVENTION EXAMPLES 5 to 10. NCV values were determined at optical densities (D) of 1, 2 and 3.

The results obtained with the thermographic recording materials of INVENTION EXAMPLES 11 to 13 are given in table 5.

TABLE 5

| Invention example number | PVB AgBeh | $SiO_2$ AgBeh | image characteristics printing with fresh material | | | | | |
|---|---|---|---|---|---|---|---|---|
| | | | $D_{max}$ | $D_{min}$ | NCV at D = 1 | NCV at D = 2 | NCV at D = 3 | NGV |
| 11 | 3 | 0.4 | 3.04 | 0.04 | 0.91 | 0.96 | 0.95 | 2.90 |
| 12 | 3 | 0.75 | 3.36 | 0.05 | 0.93 | 0.93 | 0.91 | 3.18 |
| 13 | 3 | 1 | 3.85 | 0.06 | 0.93 | 0.89 | 0.83 | 3.52 |

From these results it is clear that excellent image tone and image contast was obtained for all the thermographic materials of INVENTION EXAMPLES 11 to 13.

INVENTION EXAMPLES 14 to 17 coating of the thermosensitive element

A subbed polyethylene terephthalate support having a thickness of 175 μm was doctor blade-coated, on the side of the support opposite to that on which an antistatic layer prepared as described for INVENTION EXAMPLE 5 or 6 (as indicated in table 6) had been coated, with a coating composition containing butanone as a solvent and the following ingredients so as to obtain thereon, after drying for 1 hour at 50° C., a layer containing:

silver behenate 4.74 g/m$^2$ polyvinylbutyral (Butvar™ B79 from Monsanto) 18.92 g/m$^2$
silicone oil (Baysilone™ from Bayer AG) 0.043 g/m$^2$
benzo[e] [1,3]oxazine-2,4-dione, a toning agent 0.260 g/m$^2$
7-(ethylcarbonato)-benzo[e] [1,3]oxazine-2,4-dione, a toning agent 0.133 g/m$^2$
butyl 3,4-dihydroxybenzoate, a reducing agent 1.118 g/m$^2$
tetrachlorophthalic anhydride 0.151 g/m$^2$
pimelic acid 0.495 g/m$^2$ Coating of thermosensitive element with a surface protective layer The thermosensitive element was then coated with different aqueous compositions with the following basic composition expressed as weight percentages of ingredients present:

- 2.5% polyvinylalcohol (Mowiviol™ WX 48 20 from Wacker Chemie)
- 0.09% Ultravon™ W (dispersion agent from Ciba Geigy) converted into acid form by passing through an ion exchange column
- 0.11% talc (type P3 from Nippon Talc)
- 1.2% of colloidal silica (Levasil™ VP AC 4055 from Bayer AG, a 15% aqueous dispersion of colloidal silica)
- 2.1% tetramethylorthosilicate hydrolyzed in the presence of methanesulfonic acid and

- lubricants in the concentrations given as weight percentages in the tables below The pH of the coating composition was adjusted to a pH of 4 by adding 1N nitric acid. Those lubricants in these compositions which were insoluble in water, were dispersed in a ball mill with, if necessary, the aid of a dispersion agent. The compositions were coated to a wet layer thickness of 85 μm and were then dried at 40° C. for 15 minutes and hardened at 45° C. and a relative humidity of 70% for 7 days.

Printing and evaluation

After hardening, a commercially available AGFA DRYSTAR™ 2000 (thermal head) as described for INVENTION EXAMPLES 5 to 10 was used to produce an image over the whole width of the thermal head consisting of 11 blocks each printed at different electrical energies per dot and each with a non-printed strip in the middle thereof 2 mm wide in the printing direction and 18 cm long lateral to the printing direction, while printing the 2 mm wide and 2 cm long strips either side thereof. The degree to which the print obtained distinguised between these 2 mm wide laterally adjoining non-printed and printed strips was used as a measure of the image quality attained i.e. whether or not the two 2 mm wide and 2 cm long printed strips either side of the 2 mm wide and 18 cm long non-printed strip had been faithfully reproduced. Any non-uniform transport along the thermal head will result in the printed strips either side of the long non-printed strip not being faithfully reproduced with in the case of extremely non-uniform transport none of the 2 mm wide strips being printed i.e. additional thick white lines being observed.

The dynamic frictional coefficients were measured by modifying an AGFA DRYSTAR™ 2000 (thermal head) printer by incorporating a strain gauge so that the sideways strain generated by the recording materials in contact with the thermal head during the printing process could be determined. The electrical signal generated by the strain gauge coupled to the thermal head at load, L, of 330 g/cm of the thermal head and a transport speed of 4.5 mm/s was then converted into absolute dynamic frictional coefficients using a calibration curve generated by applying weights to the strain gauge. The dynamic frictional coefficients were measured by printing an image over the whole width of the thermal head consisting of 11 blocks each printed at different energies per dot and each with a non-printed strip in the middle thereof 2 mm wide in the printing direction and 18 cm long lateral to the printing direction, while printing the 2 mm wide and 2 cm long strips either side thereof. The dynamic frictional coefficient varied with print density. The maximum values were determined from a print-out of strain gauge response in volts as a function of time in seconds (=position on the print).

The image quality and maximum dynamic frictional coefficients are given below in table 6.

TABLE 6

| Invention example number | outermost antistatic layer of invention example number | Solid lubricant code | Solid lubricant concentration [%] | Liquid lubricant code | Liquid lubricant concentration [%] | Third lubricant code | Third lubricant concentration [%] | Image quality | maximum dynamic frictional coefficient |
|---|---|---|---|---|---|---|---|---|---|
| 14 | 12 | PSL01 | 0.18 | PLL01 | 0.09 | — | — | 1 | 0.249 |
| 15 | 12 | SL02 | 0.2 | PLL01 | 0.1 | PSL01 | 0.1 | 1 | 0.161 |
| 16 | 13 | SL01 | 0.2 | PLL01 | 0.1 | PSL01 | 0.1 | 0 | 0.170 |
| 17 | 13 | SL01 | 0.2 | LL01 | 0.1 | PSL01 | 0.3 | 1 | 0.283 |

The prints exhibited very good image quality: level 1 with additional white lines only faintly visible either side of each non-printed strip 2 mm wide and 18 cm long or excellent: level 0 with no additional white lines visible upon use of at least one solid lubricant having a melting point below 150° C. and at least one liquid lubricant in a binder, when at least one of the lubricants is a phosphoric acid derivative for both the outermost organic backside antistatic layers of INVENTION EXAMPLES 5 and 6. Furthermore, the maximum dynamic frictional coefficients were below 0.3.

INVENTION EXAMPLES 18 to 22

Support

A polyethyleneterephthalate (PET) foil was first coated on both sides with a subbing layer consisting of a terpolymer latex of vinylidene chloride-methyl acrylate-itaconic acid (88/10/2) in admixture with colloidal silica (surface area 100 m$^2$/g). After stretching the foil in the transverse direction the foil had a thickness of 175 μm with coverages of the terpolymer and of the silica in the subbing layers of 170 mg/m$^2$ and 40 mg/m$^2$ respectively on each side of the PET-foil.

Antihalation/antistatic layer

The antihalation/antistatic layers of the photothermographic recording materials of INVENTION EXAMPLES 18 to 22 were prepared by coating one side of the subbed PET-foil with an antistatic composition obtained as follows: 0.30 g of KELZAN™ S was stirred in 750 ml of deionized water until a uniform (lump-free) dispersion was obtained and then 0.2 ml of 25% ammonium hydroxide was added followed by 20 minutes stirring. The following ingredients were then added with stirring: a mixture of 22.4 mL of N-methylpyrrolidone, 0.84 g of ULTRAVON™ W, 1 ml of PERAPRET™ PE40 and 2.22 g of KIESELSOL 100F in 74.3 mL of deionized water; 50 ml (=0.6 g of dried PT-dispersion) of PT-dispersion, 66.7 mL of LATEX01, 1.2 mL of MAT02, optionally various quantities of antihalation dye D18 and 30 mL of 2-propanol to produce a layer after drying at 120° C. consisting of:

| | Invention example 18 | Invention examples 19 and 20 | Invention example 21 | Invention example 22 |
|---|---|---|---|---|
| KELZAN ™ S [mg/m$^2$]: | 7.5 | 7.5 | 7.5 | 7.5 |
| Dried PT-dispersion [mg/m$^2$]: | 15 | 15 | 15 | 15 |
| ULTRAVON ™ W [mg/m$^2$]: | 21 | 21 | 21 | 21 |
| polyethylene wax (from PERAPRET ™ PE40): | 10 | 10 | 10 | 10 |
| colloidal $SiO_2$ (from KIESELSOL ™ 100F) [mg/m$^2$]: | 20 | 20 | 20 | 20 |
| PMMA (from LATEX01) [mg/m$^2$]: | 200 | 200 | 200 | 200 |
| beads* (from MAT02) [mg/m$^2$]: | 6 | 6 | 6 | 6 |
| Antihalo dye D18 [mg/m$^2$]: | 0 | 10 | 15 | 20 |

*5.9 μm beads of crosslinked methylmethacrylate-stearylmethacrylate copolymer

The transmission absorption spectra of the antihalation/antistatic layers of the photothermographic recording materials of INVENTION EXAMPLES 19, 21 and 22 were spectrophotometrically evaluated using a DIANO™ MATCHSCAN spectrophotometer to obtain the absorption maxima in the infrared region of the spectrum, $\lambda_{max}$, and the absorptances at 830 nm, $D_{830}$. The values $D_{830}$ were measured as the infrared material with which the antihalation dyes were being used had a maximum spectral sensitivity at about 830 nm.

TABLE 7

| Invention example number | Coating weight of D18 [mg/m$^2$] | $\lambda_{max}$ [nm] | $D_{830}$ |
|---|---|---|---|
| 19 | 10 | 840 | 0.18 |
| 21 | 15 | 840 | 0.24 |
| 22 | 20 | 840 | 0.30 |

Silver halide emulsion

A silver halide emulsion consisting of 3.11% by weight of silver halide particles consisting of 97 mol % silver bromide and 3 mol % silver iodide with an weight average particle size of 50 nm, 0.47% by weight of GEL as dispersing agent in deionized water was prepared using conventional silver halide preparation techniques such as described, for example, in T. H. James, "The Theory of the Photographic Process", Fourth Edition, Macmillan Publishing Co. Inc., New York (1977), Chapter 3, pages 88–104.

Silver behenate/silver halide emulsion

The silver behenate/silver halide emulsion was prepared by adding a solution of 6.8 kg of behenic acid in 67L of 2-propanol at 65° C. to a 400L vessel heated to maintain the temperature of the contents at 65° C., converting 96% of the behenic acid to sodium behenate by adding with stirring 76.8L of 0.25M sodium hydroxide in deionized water, then adding with stirring 10.5 kg of the above-described silver halide emulsion at 40° C. and finally adding with stirring 48L of a 0.4M solution of silver nitrate in deionized water. Upon completion of the addition of silver nitrate the contents of the vessel were allowed to cool and the precipitate filtered off, washed, slurried with water, filtered again and finally dried at 40° C. for 72 hours.

8.97 g of the dried powder containing 9 mol % silver halide and 2.4 mol % behenic acid with respect to silver behenate were then dispersed in a solution of 9.15 g of Butvar™ B76 in 38.39 g of 2-butanone using conventional dispersion techniques yielding a 32% by weight dispersion. A solution of 3.31 g of Butvar™ B76 in 28.33 g of 2-butanone was then added yielding a 24.3% by weight dispersion.

Coating and drying of silver behenate/silver halide emulsion layer

An emulsion layer coating composition for the photothermographic recording materials of INVENTION EXAMPLES 18 to 22 was prepared by adding the following solutions or liquids to 88.15 g of the above-mentioned silver behenate/silver halide emulsion in the following sequence with stirring: 0.8 g of a 11.5% solution of PHP in methanol followed by a 2 hours stirring, 1 g of 2-butanone, 0.2 g of a 11% solution of calcium bromide in methanol and 1 g of 2-butanone followed by 30 minutes stirring, 0.6 g of CBBA, 1.33 g of a 0.2% solution of SENSI in 99:1 methanol:triethylamine and 0.04 g of MBI followed by 15 minutes stirring, 2.78 g of LOWINOX™ 22IB46 and finally 0.5 g of TMPS followed by 15 minutes stirring.

The PET-foil subbed and coated with an antistatic layer as described above was then doctor blade-coated at a blade setting of 150 μm on the side of the foil not coated with an antistatic layer with the coating composition to a wet layer thickness of 104 μm, which after drying for 5 minutes at 80° C. on an aluminium plate in a drying cupboard produced a layer with the following composition:

Butvar™ B76 12.49 g/m$^2$
GEL 0.045 g/m$^2$
$AgBr_{0.97}I_{0.03}$ 0.301 g/m$^2$
behenic acid 0.145 g/m$^2$
silver behenate 7.929 g/m$^2$
PHP 0.092 g/m$^2$
calcium bromide 0.022/m$^2$
LOWINOX™ 22IB46 2.78/m$^2$
CBBA 0.600 g/m$^2$
SENSI0.00266 g/m$^2$
MBI 0.04 g/m$^2$
TMPS 0.500 g/m$^2$ Protective layer A protective layer coating compositions for the photothermographic recording materials of INVENTION EXAMPLES 18 to 22 were prepared by dissolving 4.08 g of CAB and 0.16 g of PMMA in 56.06 g of 2-butanone and 5.2 g of methanol adding the following solids with stirring in the following sequence: 0.5 g of phthalazine, 0.2 g of 4-methylphthalic acid, 0.1 g of tetrachlorophthalic acid, 0.2 g of tetrachlorophthalic acid anhydride and finally, in the case of INVENTION EXAMPLE 20, 15 mg of antihalation dye D01.

The emulsion layer was then doctor blade-coated at a blade setting of 100 μm with the protective layer coating composition to a wet layer thickness of 70 μm, which after drying for 8 minutes at 80° C. on an aluminium plate in a drying cupboard produced a layer with the following composition:

| | INVENTION EXAMPLE 20 | INVENTION EXAMPLES 18,19,21,22 |
|---|---|---|
| CAB | 4.08 g/m² | 4.08 g/m² |
| PMMA | 0.16 g/m² | 0.16 g/m² |
| phthalazine | 0.50 g/m² | 0.50 g/m² |
| 4-methylphthalic acid | 0.20 g/m² | 0.20 g/m² |
| tetrachlorophthalic acid | 0.10 g/m² | 0.10 g/m² |
| tetrachlorophthalic acid anhydride | 0.20 g/m² | 0.20 g/m² |
| antihalation dye D01 | 0.015 g/m² | — |

Image-wise exposure and thermal processing

The photothermographic recording materials of INVENTION EXAMPLES 18 to 22 were exposed to a 849 nm single mode diode laser beam from SPECTRA DIODE LABS with a nominal power of 100 mW of which 50 mW actually reaches the recording material focussed to give a spot diameter ($1/e^2$) of 28 μm, scanned at speed of 50 m/s with a pitch of 14 μm through a wedge filter with optical density varying between 0 and 3.0 in optical density steps of 0.15.

Thermal processing was carried out for 10s on a drum heated to a temperature of 119° C. and the $D_{max}$- and $D_{min}$-values of the resulting wedge images were evaluated with a MACBETH™ TD904 densitometer with an ortho filter to produce a sensitometric curve for the photothermographic material and the image sharpness was assessed qualitatively using the following numerical codes:

0=unacceptable image sharpness

1=poor image sharpness

2=acceptable image sharpness

3=good image sharpness

The results of the image characteristic evaluation for the photothermographic recording materials of INVENTION EXAMPLES 18 to 22 are summarized in table 8.

TABLE 8

| Invention example number | Coating weight of D18 [mg/m²] | Coating weight of D01 [mg/m²] | image characteristics $D_{max}$ | $D_{min}$ | Image sharpness |
|---|---|---|---|---|---|
| 18 | 0 | 0 | 3.65 | 0.21 | 0 |
| 19 | 10 | — | 3.95 | 0.20 | 2 |
| 20 | 10 | 15 | 3.50 | 0.24 | 3 |
| 21 | 15 | — | 3.70 | 0.20 | 2–3 |
| 22 | 20 | — | 3.50 | 0.21 | 3 |

From these results it is clear that the incorporation of 10 to 20 mg/m² of D18 in the antihalation/antistatic backside layer or 10 mg/m² of D18 in the antihalation/antistatic backside layer together with 15 mg/m² of D01 in the protective layer enables an image with an acceptable to good image sharpness to be obtained, whereas the non-use thereof produces an image with unacceptable image sharpness.

Having described in detail preferred embodiments of the current invention, it will now be apparent to those skilled in the art that numerous modifications can be made therein without departing from the scope of the invention as defined in the following claims.

We claim:

1. A thermographic recording material comprising a thermosensitive element, a support and an outermost antistatic layer, said thermosensitive element comprising a substantially light-insensitive organic silver salt, an organic reducing agent for said substantially light-insensitive organic silver salt in thermal working relationship therewith and a binder, wherein said outermost antistatic layer is an organic layer with a resistivity of $<10^{10}\Omega/\square$ at a relative humidity of 30% and comprises a polythiophene with conjugated polymer backbone in the presence of a polymeric polyanion compound and a hydrophobic organic polymer having a glass transition value ($T_g$) of at least 40° C. said polythiophene being present at a coverage of at least 0.001 g/m² and the weight ratio of said polythiophene to said hydrophobic organic polymer being in the range of 1/10 to 1/1000.

2. Thermographic recording material according to claim 1, wherein the weight ratio of polythiophene polymer to polymeric polyanion compound(s) is from 50/50 to 15/85.

3. Thermographic recording material according to claim 1, wherein said thermosensitive element is provided with an outermost layer, which is not said outermost organic antistatic layer, comprising at least one solid lubricant having a melting point below 150° C. and at least one liquid lubricant in a binder, wherein at least one of said lubricants is a phosphoric acid derivative.

4. Thermographic recording material according to claim 1 or 3, wherein said thermosensitive element comprises a layer comprising at least one substantially light-insensitive organic silver salt in at least one binder and in thermal working relationship therewith an organic reducing agent therefor, said layer further containing colloidal particles comprising silicon dioxide at a coating weight given by expression (1):

$$0.015 \times \frac{B}{AGOS} < \frac{S}{AGOS} < 1.2\left(\frac{B}{AGOS} - 0.4\right) \quad (1)$$

wherein B represents the total weight of all binders in said layer, AGOS represents the total weight of all organic silver salts in said layer and S represents the weight of said colloidal particles in said layer.

5. Thermographic recording material according to claim 1, wherein said outermost organic antistatic layer further comprises at least one member selected from the group consisting of matting agents, friction lowering substances, fluor-substituted organic surface active agents and spacing agents.

6. Thermographic recording material according to claim 1, wherein said thermosensitive element further comprises photosensitive silver halide in catalytic association with said substantially light-insensitive organic silver salt or a component which is capable of forming photosensitive silver halide with said substantially light-insensitive organic silver salt.

7. Thermographic recording material according to claim 6, further comprising an antihalation dye in a layer thereof.

8. Thermographic recording material according to claim 7, wherein said antihalation dye is in a layer on the same side of said support as said photo-addressable thermosensitive element and/or in an outermost layer on the other side of said support.

9. Thermographic recording material according to claim 1 or 8, wherein said outermost organic antistatic layer is on the opposite side of said support to said thermosentive element.

10. Thermographic recording material according to claim 7, wherein said antihalation dye is a bis-indolenino-cyanine dye.

11. A method of producing a thermographic recording material comprising the steps of: (i) coating one side of a support with a thermosensitive element comprising a substantially light-insensitive organic silver salt, an organic reducing agent for said substantially light-insensitive organic silver salt in thermal working relationship therewith and a binder; and (ii) coating from an aqueous dispersion or solution one side of said thermosensitive element coated support with an outermost antistatic layer, wherein said outermost antistatic layer is an organic layer with a resistivity of $<10^{10}\Omega/\square$ at a relative humidity of 30% and comprises a polythiophene with conjugated polymer backbone in the presence of a polymeric polyanion compound and a hydrophobic organic polymer having a glass transition value ($T_g$) of at least 40° C., said polythiophene being present a t a coverage of at least 0.001 $g/m_2$ and the weight ratio of said polythiophene to said hydrophobic organic polymer being in the range of 1/10 to 1/1000.

12. Method according to claim 11, comprising the step of coating said outermost organic antistatic layer from an aqueous dispersion of said hydrophobic organic polymer in the presence of an organic solvent or swelling agent for said hydrophobic organic polymer.

13. Method according to claim 11, wherein said outermost organic antistatic layer is on the opposite side of said support to said thermosensitive element.

14. A thermographic recording process comprising the steps of: (i) bringing an outermost layer of a thermographic recording material comprising a thermosensitive element, a support and an outermost antistatic layer, said thermosensitive element comprising comprising a substantially light-insensitive organic silver salt, an organic reducing agent for said substantially light-insensitive organic silver salt in thermal working relationship therewith and a binder, into contact with a heat source; (ii) applying heat from said heat source imagewise to said thermographic recording material while maintaining mutual contact to but with relative movement between said thermographic recording material and said heat source; and (iii) separating said thermographic recording material from said heat source, wherein said outermost antistatic layer is an organic layer with a resistivity of $<10^{10}\Omega/\square$ at a relative humidity of 30% and comprises a polythiophene with conjugated polymer backbone in the presence of a polymeric polyanion compound and a hydrophobic organic polymer having a glass transition value ($T_g$) of at least 40° C., said polythiophene being present at a coverage of at least 0.001 $g/m^2$ and the weight ratio of said polythiophene to said hydrophobic organic polymer being in the range of 1/10 to 1/1000.

15. Thermographic recording process according to claim 14, wherein the outermost layer in contact with said heat source is not said outermost organic antistatic layer and the maximum dynamic frictional coefficient during said contact between said outermost layer in contact with said heat source and said heat source is less than 0.3.

* * * * *

UNITED STATES PATENT AND TRADEMARK OFFICE

CERTIFICATE OF CORRECTION

PATENT NO. : 5,747,412

DATED : May 5, 1998

INVENTOR(S) : Leenders, et al

It is certified that error appears in the above-identified patent and that said Letters Patent is hereby corrected as shown below:

Column 6, before line 53, the following formula should be inserted:

(III)

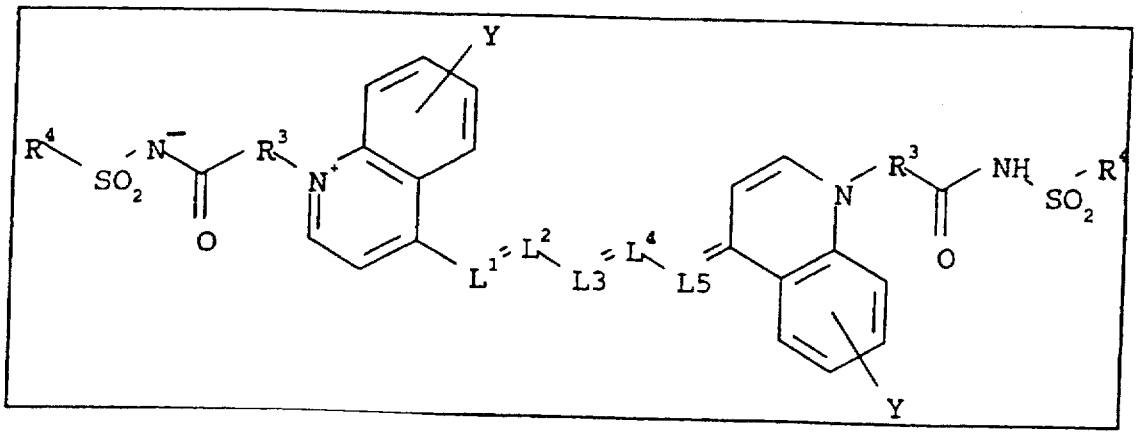

UNITED STATES PATENT AND TRADEMARK OFFICE

CERTIFICATE OF CORRECTION

PATENT NO. : 5,747,412

DATED : May 5, 1998

INVENTOR(S) : Leenders, et al

It is certified that error appears in the above-identified patent and that said Letters Patent is hereby corrected as shown below:

Column 11, line 3 of formula "D11", "N+" should read -- N --;

Column 13, line 53, "possible on" should read --possible. On--.

Signed and Sealed this
First Day of February, 2000

*Attest:*

*Attesting Officer*

Q. TODD DICKINSON

*Acting Commissioner of Patents and Trademarks*